United States Patent [19]

Taylor

[11] Patent Number: 4,910,983

[45] Date of Patent: Mar. 27, 1990

[54] KEY TURNING AND STARTER SWITCH ASSISTANCE DEVICE

[76] Inventor: Robert B. Taylor, 1316 N. Fiske Blvd., Cocoa, Fla. 32922

[21] Appl. No.: 221,752

[22] Filed: Jul. 20, 1988

[51] Int. Cl.[4] ..... E05B 19/04; A44B 15/00

[52] U.S. Cl. ..... 70/456 R; 70/408; 70/454

[58] Field of Search ..... 206/37.1–37.8, 206/38.1; 24/3 K; D3/61–65, 103; 70/456 R, 456 B, 457, 458, 459, 453–455, 408

[56] References Cited

U.S. PATENT DOCUMENTS

| | | | |
|---|---|---|---|
| 4,53,383 | 4/1986 | Bosco et al. | 70/458 X |
| 1,924,134 | 8/1933 | Segal | 70/456 R |
| 1,974,547 | 9/1934 | Slade | 70/456 R |
| 2,842,954 | 7/1958 | Schindler | 70/456 |
| 2,849,044 | 8/1958 | Reitzel | 206/37.1 |
| 3,101,762 | 8/1963 | Bermingham et al. | 206/37.3 |
| 3,457,746 | 7/1969 | Glassman | 70/408 |
| 3,464,244 | 9/1969 | Hinkle et al. | 70/456 R |
| 3,587,260 | 6/1971 | Tajiri | 70/408 X |
| 4,262,508 | 4/1981 | Davidson | 70/455 |

FOREIGN PATENT DOCUMENTS

| | | | |
|---|---|---|---|
| 2226385 | 12/1973 | Fed. Rep. of Germany | 70/456 R |
| 2601286 | 7/1977 | Fed. Rep. of Germany | 70/456 R |
| 2712759 | 9/1978 | Fed. Rep. of Germany | 70/408 |

*Primary Examiner*—Gary L. Smith
*Assistant Examiner*—Suzanne L. Dino
*Attorney, Agent, or Firm*—Warren L. Franz

[57] ABSTRACT

A device for assisting the crippled hand to turn a key in an automobile starter switch lock has an elongated member that firmly grips opposite faces of the key head and has longitudinal portions which rigidly extend the moment arm for application of turning force. In one form the device has recesses to receive the tabs of a steering column mounted starter switch. In another form, the device has a protuberance to project the key into the recess of a recessed switch on a dashboard. A preferred embodiment has hinged rigid panels with hollowed internal surfaces that mount keys for slidable and pivotal movement along tracked guideways. The internal surfaces have raised marginal edges interrupted by a slot through which the shank of a key may be passed.

13 Claims, 2 Drawing Sheets

KEY TURNING AND STARTER SWITCH ASSISTANCE DEVICE

This invention relates to a device facilitating the turning of a key in a keyhole of a lock and for facilitating the actuation of an automobile starter or ignition switch.

BACKGROUND OF INVENTION

Keys are normally elongated relatively planar implements having a manually grippable enlarged bow or head located at one end and a keyhole insertable longitudinally extending blade or shank at the other end. In the normal use of a key operated lock, the shank of the key is inserted into the keyhole and turned to rotate a plug or core of a lock cylinder to bring about a desired operation, such as the mechanical unlocking of a door bolt or the actuation of a machine switch. Individualized angled serrations or cuts on the key blade correspond to different sized pin tumblers or pins within the lock cylinder to necessitate a complementary match between the key and the lock before the key can be turned.

In a usual operation, the key is inserted for the full length of its shank portion into the keyway of the lock. A widening of the key between its shank and head portions ensures proper positioning. The exposed head provides an enlarged surface which is gripped by the user's fingers to exert torque for turning the key about its shank axis.

The small heads of modern keys can be difficult to grip, especially by he elderly or infirm. The turning of the small flat key typically supplied for actuating a starter or ignition switch of an automobile, for example, can be particularly troublesome for a person whose hands have been crippled by arthritis.

Some automobiles are equipped with manually grippable tabs diagonally disposed on opposite sides of a rotary keyhole member of a steering column mounted ignition switch. Such switches typically have a smaller thumb operable front tab and a larger finger operable rear tab. Although such tabs offer some relief and permit the turning force to be applied through the tabs rather than the head of the key, for the infirm hand such a solution is not adequate, still leaving the lone crippled handed driver in the embarrassing and awkward situation of having to ask a passerby to start the car.

Other automobile designs compound the difficulty by providing ignition switch locks which are recessed to be set back into the dashboard or other lock mounting surface. With such sunken switches, there is little enough room for manipulation of a key by even a person with normal dexterity, to say nothing of the added difficulties imposed on the elderly or infirm driver.

Various keyholders exist which make provision for mounting keys for movement between positions of internal stowage and positions in which the shank projects externally for insertion into a keyhole. There is a tendency for such keyholders to be made of soft pliant materials (e.g. leather or plastic), however, and to trail the key limply when the key is extended into the lock. This does not offer any key turning assistance. Other keyholders have elaborate key projecting mechanisms that require considerable agility to operate. Satisfactory keyholders of simple design that aid the crippled hand are lacking.

SUMMARY OF THE INVENTION

It is an object of the present invention to overcome the above and other drawbacks of the prior art by providing a device for facilitating the turning of a key in a keyhole of a lock, such as for assisting a person with crippled hands to actuate an automobile ignition switch lock, by acting to rigidly lengthen the effective moment arm for manual application of turning force.

In one aspect of the invention, a keyholder is provided with means mounting a key thereon for movement between an enclosed stowage position and an extended position in which the key shank is exposed for insertion in a keyhole and the faces of the key head are firmly gripped by the holder to transversely extend the manually grippable area, in order to lessen the amount of turning force necessary to attain the required torque to rotate the key in the lock. In a preferred embodiment, described in greater detail below, a holder is provided in the form of hinged rigid panels with means slidably and pivotally mounting a key on an internal guideway for movement in simple manner from a stowage position within an interior chamber provided by the panels to a position in which the shank of the key projects through an opening in contacting marginal borders of the panels. The panels act when the key is in its shank projecting position to rigidly lengthen the effective moment arm for manual application of turning force.

In another aspect of the invention, a device is provided for facilitating the turning of manually grippable tabs found on an automobile key ignition switch. Such device comprises a member adapted for attachment in firmly gripping manner to a key including recesses located to receive and confine the tabs when the key is inserted into the switch keyhole, and functioning to reduce the amount of force required to turn the tabs.

In a further aspect of the invention, a device is provided for facilitating the turning of a key in a keyhole of a recessed lock. The device includes a protruding portion for firmly gripping opposite faces of a key head and a setback portion which rigidly extends the effective moment arm for manual application of a turning force to the key.

BRIEF DESCRIPTION OF THE DRAWINGS

Embodiments of the invention have been chosen for purposes of illustration and description and are shown in the accompanying drawings, wherein.

Throughout the drawings, like elements are referred to by like numerals.

DESCRIPTION OF THE PREFERRED EMBODIMENTS

Figure 1:
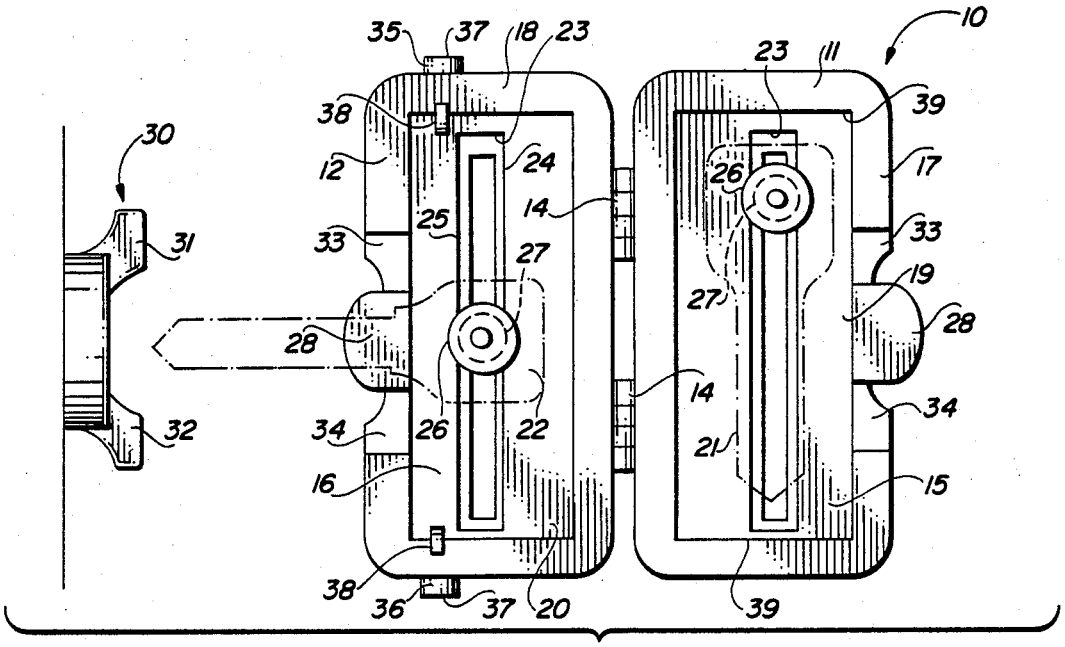
FIG. 1 a top plan view of a device in accordance with the invention, in the form of a keyholder shown in its panel open position.
Figure 2:
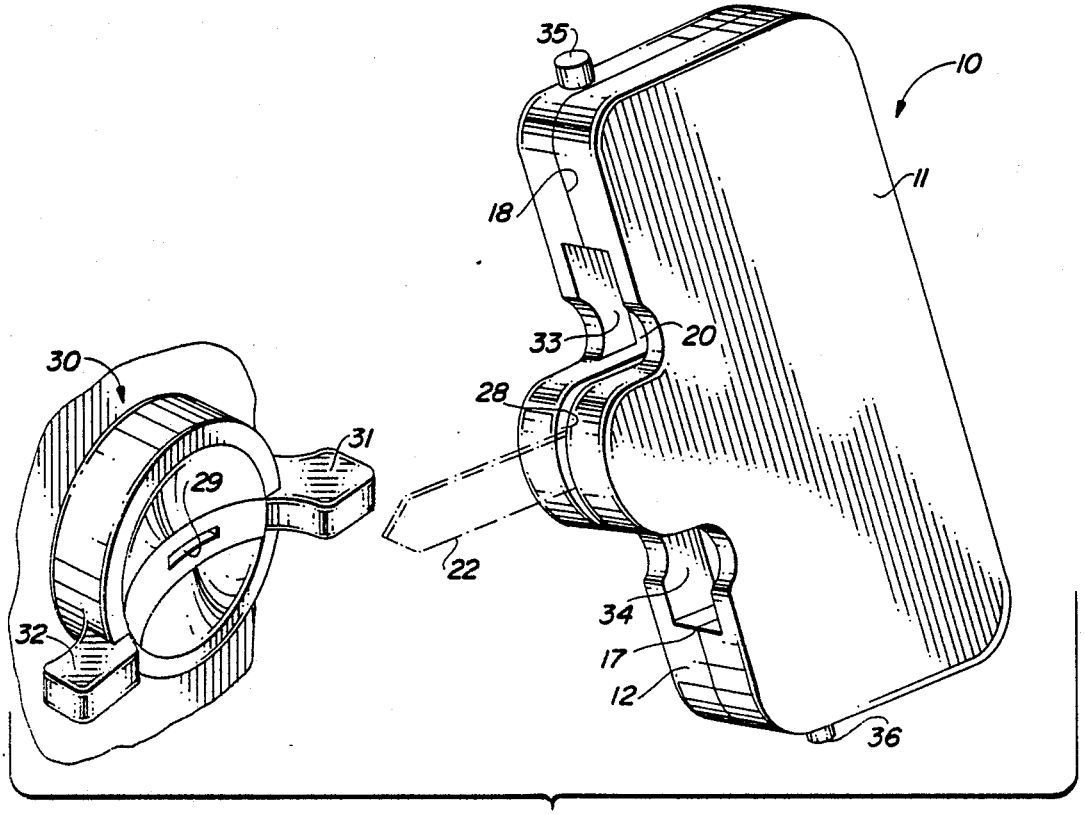
FIG. 2 is a perspective view of the keyholder of FIG. 1, shown in its closed position.

As shown in FIGS. 1 and 2, a keyholder 10 comprises rigid front and rear panels 11, 12 pivotally connected by means of hinges 14 for movement between an open position (shown in FIG. 1) in which the panels 11, 12 are pivoted away from each other to expose hollowed internal surfaces 15, 16, and a closed position (shown in FIG. 2) in which the panels are brought into opposing relationship.

For the embodiment shown in FIGS. 1 and 2, the panels 11, 12 have generally complementary rectangular shapes with the hinges 14 accommodated along adjacently positioned long sides thereof. The internal surfaces 15, 16 are provided with raised marginal edges 17, 18 extending peripherally about the surfaces and which establish border contact with each other when the panels 11, 12 are brought into the closed position of FIG. 2. The central hollowed areas 19, 20 within the borders 17, 18 provide depressions for the convenient storage of keys 21, 22 (shown in phantom). When the panels 11, 12 are brought into opposing closed position (FIG. 2), the hollowed areas 19, 20 overlie each other to form a interior key stowage chamber.

Each key 21, 22 is pivotally and slidably mounted at its head to a guideway 23 which, for the embodiment shown, comprises a run of two parallel tracks 24, 25 spaced from each other across a gap, the run being a straight run parallel to the long sides of the panels 11, 12. As shown, the heads are conveniently mounted by means of sliding elements comprising fasteners 26, 27 respectively positioned on either side of the gap, releasably connected to each other through the gap and passing through an opening in the head of the key. The keys are mounted so that they may be brought from a stowage position (position of key 21 in FIG. 1) wherein the fasteners 26, 27 are adjacent one end of the guideway 23 and the key is aligned longitudinally with the area 19, to a key extended position (position of key 22) wherein the fasteners 26, 27 are brought to the center of guideway 23 and the key is pivoted to extend perpendicularly to the longitudinal axis of the panel 12.

Each marginal edge 17, 18 is provided with a cutout or slot 28 at its center through which the shank of the key can be extended for insertion into a keyhole of a lock, such as a keyhole 29 of an automobile ignition switch lock 30 having manually grippable tabs 31, 32 diagonally disposed thereon as shown. The interrupted marginal edge portion 28 is dimensioned to firmly grip opposite faces of the head of a key when the panels are brought into their closed position (FIG. 2). Deeper slots or recesses 33, 34 are disposed on opposite sides of the passageway 28, so that when the holder 10 is in its closed position (FIG. 2) and the shank of a key 22 is projected outwardly into the keyhole 29, the tabs 31, 32 will be received and confined within the slots 33, 34 for rotation with the keyholder 10.

To secure the panels 11, 12 in their closed position, releasable closure members 35, 36 are provided at opposite ends of the panel 12. Each closure member comprises a spring-biased pushbutton end 37 manipulable from the exterior of the holder 10 and an opposite hooked end 38 extending into the hollowed area 20 of the internal surface 16. A lip 39 extends laterally at a spaced position above the hollowed area 19 of the internal surface 15 opposite each hooked end 38, so that the hooked end can be releasably latched in known manner in response to manipulation of the pushbutton.

The holder 10, thus described, provides a rigid housing for stowage of keys 21, 22 within an interior chamber formed by opposing hollowed areas 19, 20 thereof, presenting smooth external surfaces when the holder is in its closed position (FIG. 2). Keys are moved out of their stowed position (key 21 position) by pressing the pushbuttons 37 to open the holder, and then sliding the fasteners 26, 27 of a selected key to the center of the guideway 23 and pivoting the key by 90° to its extended position (key 22 position). The case is then reclosed, the pushbutton mechanism 37 being spring-loaded in known manner to permit automatic latching when the panels 11, 12 are brought together.

In the closed position (FIG. 2), the shank of key 22 projects outwardly from the holder 10 with its head firmly gripped between the noncontacting sections 28 of the marginal edges 17, 18 of the panels 11, 12. When the shank of the key is brought within the keyhole 29 of lock 30, the slots 33, 34 on each side of the extended key 21 function to capture the tabs 31, 32. The longitudinal portions of the panels 11, 12 extend perpendicularly at both sides of the key, the recesses 28 being dimensioned to firmly grip the key and/or the tabs for rotation with the holder 10. The key is restrained against movement into or out of the holder 10 because the shank axis is turned at right angles to the channel axis of guideway 23 (see key 22 position in FIG. 1).

The external surfaces of the panels 11, 12 may now be gripped for manual application of turning force to rotate the key 22 in the lock 30. The described holder functions so that longitudinal portions of the panels 11, 12 act to rigidly lengthen the effective moment arm for application of torque to the key 22 and the tabs 31, 32, thereby lessening the force necessary to actuate the switch. Both the pushbutton release and the key mounting means are readily usable by a crippled hand. The length of the panels is chosen to exceed the length of the stowed key and also of a length sufficient to extend the moment arm to a workable force for the intended application.

Figure 3:
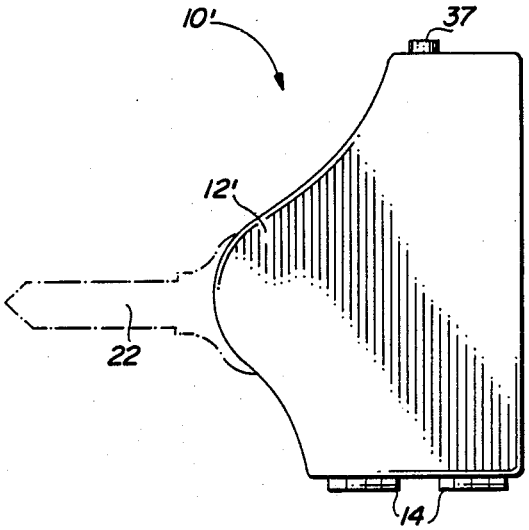
FIG. 3 is a top plan view of a modified form of the embodiment of FIG. 1, shown in its panel closed position.
Figure 4:
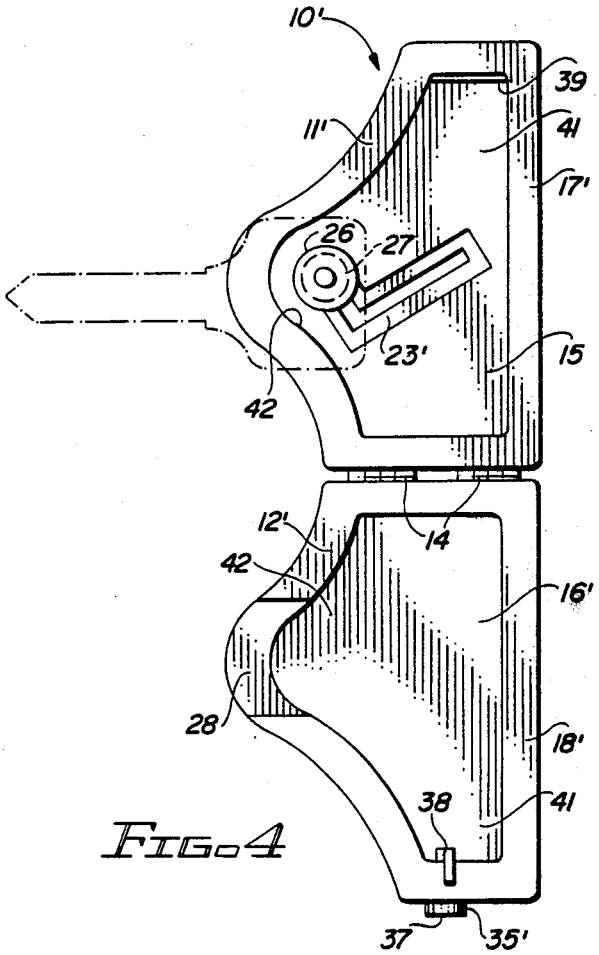
FIG. 4 is a view as in FIG. 3 with the holder, shown in its panel open position.

A modified form of the holder of FIGS. 1 and 2 is shown by the holder 10' of FIGS. 3 and 4. The holder 10' is configured to facilitate the turning of a key in a keyhole of a recessed lock, such as a dashboard mounted automobile ignition switch lock in which the keyhole is in sunken position inwardly of the dashboard surface. Manipulation of such a switch is difficult for the cripple hand because the lock is configured to require part or all of the head of a key to be received within the recess, making it difficult to grip and turn. As shown in FIGS. 3 and 4, the panels 11', 12' are dimensioned to protrude laterally intermediate their ends, to present a protuberance at their midportions when the panels are in the closed position (FIG. 3). As shown, each panel 11', 12' and the corresponding internal surfaces 15', 16' has a generally rectangular portion 41 joined along one length by a generally triangular projecting portion 42. The triangular portion 42 is dimensioned for presenting the gripped key within the recess of the lock ahead of the longitudinal portions of part 41. As with the slots 28 in the marginal edges 17, 18 of the panel 11, 12 of holder 10 previously described, slot 28' is provided in the marginal edges 17' of one or both of the panels 11', 12' to permit the key to extend outwardly from the interior of the holder 10' when the holder is in its closed position (FIG. 3).

The embodiment of FIG. 3 an 4 includes a guideway 23' in the form of L-shaped tracks oriented transversely against a hollowed area of the internal surface 15'. The guideway 23' functions similarly to the guideway 23 of FIGS. 1 and 2, already described. A key 22 is mounted by means of slider members 26, 27 to the tracks of the guideway 23' for movement from one end in which the key is in a stowage position (similar to that shown for key 22 in FIG. 1), to an extended position (shown in FIGS. 3 and 4) in which the slider fasteners are brought to the other end of the guideway 23' and the key is pivoted to be perpendicular to the axis of the longitudinal portion 41 of the holder 10'. The L-shape of guideway 23' provides a downward angle at its portion 42 end which serves to prevent the key 22 from moving axially of the shank when inserted in the lock.

The embodiment of FIG. 3 and 4 shows panels 11', 12' hinged at adjacent short edges of the rectangular portions 41 and with a closure 35' accommodated at the opposite short ends.

Figure 5:
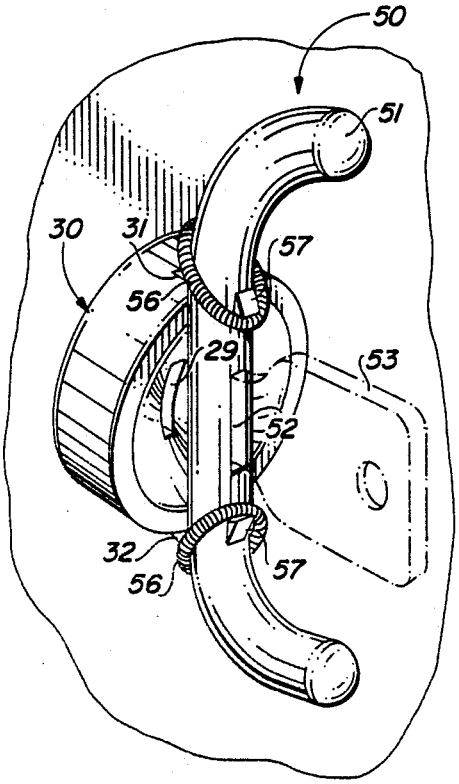
FIG. 5 is a perspective view of another embodiment of a device in accordance with the invention.

FIG. 5 shows an alternative embodiment 50 of a device for facilitating the turning of manually grippable tabs 31, 32 of an automobile key ignition switch 30, which does not have the key stowage features of the previously described embodiments. As shown in FIG. 5, an elongated tubular member 51 has a longitudinal slot 52 extending laterally therethrough at a location centrally thereof. The slot 52 is wide enough to snugly hold a key 53 (shown in phantom) with its shank passing through the slot 52 into the keyhole 29 of starter switch 30. Springs 56 received on opposite ends of the slot 52 extend around the lugs 31, 32 of switch 30 to hold them within the confines of a longer front opening of the slot 52. The slot 52 firmly grips the head of key 53 and tabs 31, 32 so that the same rotate with the member 51.

The ends of the member 51 are curved away from the lock 30 to provide convenient manually grippable surfaces. Projections 57 are located at convenient places on the member 51 opposite the tabs 31, 32 to position the springs 56 so that they provide a centrally directed force to hold the tabs 31, 32 within the front of slot 52. The tubular member 51 of the embodiment 50, shown in FIG. 5 can be retained on the switch 30, if desired, with only the key 53 being removed when not in use. The device 50 operates to extend the effective moment arm provided by the tabs 31, 32 thereby reducing the amount of force needed to be applied by, for example, a crippled hand to deliver the torque necessary to actuate the switch.

Figure 6:
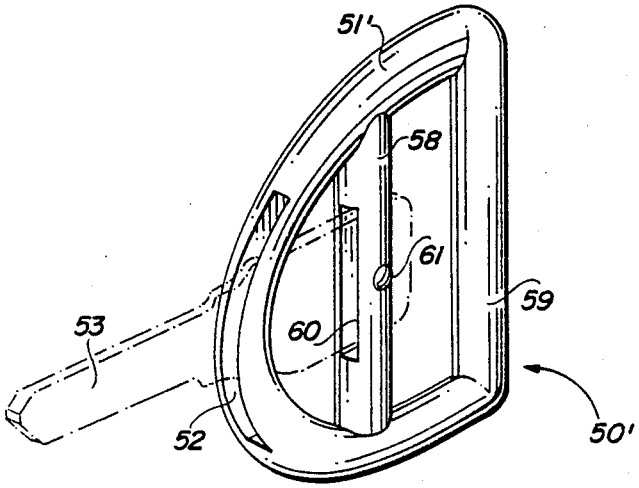
FIG. 6 is a perspective view of a modified form of the embodiment of FIG. 5.

FIG. 6 shows a modified form 50' of the device 50 of FIG. 5, intended for removal from the switch 30 with the key 5. With the modified design of FIG. 6, the arcuate tubular member 51' is provided with transverse members 58, 59 extending between opposite runs of the tube 51'. The member 58 is provided with a slot 60 coaxial to the slot 52 into which a portion of the head of the key 53 can be received. A removable fastener 61, such as a nut and bolt, can be inserted through the member 58 and a bore of the key 53 to retain the key 53 with the device 50'. The crossmember 59 at the free end of the arc of the member 51' serves as an additional gripping surface for the user of the device 50'. The lengthened extent of the slot 52 facing the lock 30 serves to receive tabs 31, 32 as with the device 50 of FIG. 5. Alternatively, the forward portion of the tube 51' of the member 50' can be made to project in a manner similar to the forward projection of the keyholder 10' of FIGS. 3 and 4, so that the key 53 can be presented into a recessed lock ahead of the crossmember 59 to provide a starting switch assist for a recessed lock.

As is apparent from the foregoing discussion, the invention provides structure for facilitating the turning of a key in a keyhole of a lock and for facilitating the rotation of turning assist tabs provided on the lock itself. The moment arm previously provided by the key head or such tabs is effectively increased to lessen the magnitude of turning force needed to produce a particular torque for achieving the result desired.

It will be appreciated by those skilled in the art to which the invention relates that various substitutions and modifications may be made to the embodiments described without departing from the spirit and scope of the invention as defined by the claims appended hereto. In particular, it will be appreciated that the dimensions and configurations of the various embodiments may be modified to suit particular tastes and demands and that one key versions described can be embellished to provide for multiple key stowage and that multiple key versions can be modified to accommodate single keys. It will also be appreciated that the teachings of the embodiments of FIGS. 1–2 and FIGS. 3–4 and similar embodiments can be combined so that a single unit can be provided which has both slots to receive the tabs 31, 32 and a forward protuberance to reach into a recess lock.

What is claimed is:

1. A keyholder for facilitating the turning of a key in a keyhole of a lock, such as a steering wheel mounted automobile ignition switch lock, having manually grippable tabs diagonally disposed on said lock for assisting the turning of said key, comprising:

rigid, elongated front and rear panels with external and internal surfaces, said panels being hingedly connected for movement between an open position in which said panels are pivoted away from each other exposing said internal surfaces, and a closed position in which said panels are pivoted towards each other bringing said internal surfaces into opposing relationship to form an interior chamber; at least one of said internal surfaces having a raised marginal edge for establishing border contact with said other internal surface when said panels are in said closed position, said marginal edge being interrupted at a midportion to provide a noncontacting section thereof;

a guideway located on one of said internal surfaces; and means for pivotally and slidably mounting a head of a key to said guideway for movement along said guideway between a key stowage position in which said key is fully received within said chamber in said panel closed position, and a key extended position in which said head is within said chamber in said panel closed position and a shank of said key projects externally through said noncontacting edge section transversely to said panels, with opposite faces of said head firmly gripped by said panels so that longitudinal portions of said panels act to rigidly lengthen the effective moment arm for manual application of turning force to rotate said key in said lock;

wherein said panels in said closed position further define slots disposed on opposite sides of said noncontacting section which are dimensioned and configured to receive and confine said tabs for rotation with said keyholder when said shank is inserted in said key extended position into said keyhole.

2. A keyholder as defined in claim 1, wherein said guideway comprises a run of two parallel tracks spaced from each other across a gap, and wherein said mounting means comprises a first sliding element positioned on one side of said gap, a second sliding element positioned on the other side of said gap, and means passing through said gap and adapted for passing through a hole formed in said key head for interconnecting said sliding elements.

3. A keyholder as defined in claim 2, wherein said panels an said internal surfaces are generally rectangular, and wherein said run is a straight run parallel to said long sides of said one of said internal, surfaces.

4. A keyholder as in claim 3, wherein each of said internal surfaces has a raised marginal edge and a guideway as defined, and each guideway has associated with it mounting means as defined for slidably and pivotally respectively mounting a different key, so that said keyholder enables the selective alternative presentation of either key in key extended position.

5. A keyholder as defined in claim 1, further comprising means for releasably securing said panels in said closed position.

6. A keyholder as defined in claim 5, wherein said securing means further comprises a push button closure member extending from said external surface to said internal surface of a first one of said panels and including a hooked interior end, and a lip positioned on said internal surface of a second one of the panels so that said hooked end can be releasably latched thereunder in response to manipulation of said hooked end.

7. A keyholder for facilitating the turning of a key in a keyhole of a lock, such as for assisting a person with crippled hands to turn a key to actuate an automobile ignition switch lock or the like, comprising:

rigid, elongated front and rear panels with external and internal surfaces, said panels being hingedly connected for movement between an open position in which said panels are pivoted away from each other exposing said internal surfaces, and a closed position in which said panels are pivoted towards each other bringing said internal surfaces into opposing relationship to form an interior chamber; at least one of said internal surfaces having a raised marginal edge for establishing border contact with said other internal surface when said panels are in said closed position, said marginal edge being interrupted at a midportion to provide a noncontacting section thereof; and said panels and said internal surfaces each comprising a generally rectangular portion having a long side and a generally triangular portion joining said long side of said rectangular portion;

a guideway located on one of said internal surfaces, said guideway being an L-shaped run oriented transversely to said long side of said one of said internal surfaces; and means for pivotally and slidably mounting a head of a key to said guideway for movement along said guideway between a key stowage position in which said key is fully received within said chamber in said panel closed position, and a key extended position in which said head is within said chamber in said panel closed position and a shank of said key projects externally through said noncontacting edge section transversely to said panels, with opposite faces of said head firmly gripped by said panels so that longitudinal portions of said panels act to rigidly lengthen the effective moment arm for manual application of turning force to rotate said key in said lock.

8. A keyholder as defined in claim 7, wherein said guideway comprises a run of two parallel tracks spaced from each other across a gap, and wherein said mounting means comprises a first sliding element positioned on one side of said gap, a second sliding element positioned on the other side of said gap, and means passing through said gap and adapted for passing through a hole formed in said key head for interconnecting said sliding elements.

9. A device for facilitating the turning of manually grippable tabs of an automobile key ignition switch, or the like, comprising:

a member including a housing with an interior chamber and means adapted for mounting a head of a key for movement between a key stowage position in which said key is received within said chamber, and a key extended position in which said head is within said chamber and a shank of said key projects externally of said chamber, with opposite faces of said head firmly gripped by said housing, said housing including recesses located to receive and confine said tabs when said shank of said mounted key in said key extended position is inserted into the keyholder of said switch, and said housing being dimensioned and configured when said tabs are thus received and confined to rigidly extend the effective moment arm for the manual application of a turning force to said tabs, so as to reduce the amount of force required to actuate said switch.

10. A device as defined in claim 9, further comprising means for releasably attaching said member to said tabs.

11. A device as defined in claim 9, wherein said member comprises an elongated member formed with a central slot through which to project said key, and wherein said recesses comprise extensions of said central slot on opposite sides of said central slot.

12. A device as defined in claim 11, further comprising means for releasably securing said key to said member.

13. A device as defined in claim 9, wherein said housing comprises:

rigid front and rear panels with external and internal surfaces, said panels being hingedly connected for movement between an open position in which said panels are pivoted away from each other exposing said internal surfaces, and a closed position in which said panels are pivoted towards each other bringing said internal surfaces into opposing relationship to form said interior chamber; said recesses being formed on said panels to appear along a peripheral edge thereof when said panels are in said closed position, and said panels further having a slot at said peripheral edge located intermediate said recesses; and said mounting means comprises:

means mounting said head of said key to said panels for movement between said key stowage position in which said key is fully received within said chamber in said panel closed position, and said key extended position in which said head is within said chamber in said panel closed position and a shank of said key projects externally through said slot, with opposite faces of said head firmly gripped by said panels so that transversely extending portions of said panels act to rigidly lengthen said moment arm.

* * * * *